US008105443B2

(12) United States Patent
Reppel et al.

(10) Patent No.: US 8,105,443 B2
(45) Date of Patent: Jan. 31, 2012

(54) NON-AGEING PERMANENT MAGNET FROM AN ALLOY POWDER AND METHOD FOR THE PRODUCTION THEREOF

(75) Inventors: Georg Werner Reppel, Hammersbach (DE); Volker Zellmann, Linsengericht (DE)

(73) Assignee: Vacuumschmelze GmbH & Co., Hanau (DE)

( * ) Notice: Subject to any disclaimer, the term of this patent is extended or adjusted under 35 U.S.C. 154(b) by 593 days.

(21) Appl. No.: 12/226,709

(22) PCT Filed: Apr. 25, 2007

(86) PCT No.: PCT/IB2007/051519

§ 371 (c)(1),
(2), (4) Date: Dec. 5, 2008

(87) PCT Pub. No.: WO2007/122590

PCT Pub. Date: Nov. 1, 2007

(65) Prior Publication Data

US 2009/0127493 A1 May 21, 2009

(30) Foreign Application Priority Data

Apr. 25, 2006 (DE) ..... 10 2006 019 614

(51) Int. Cl.
*H01F 1/047* (2006.01)

(52) U.S. Cl. ..... 148/101; 148/104; 148/103; 148/301; 148/302; 252/62.53; 419/65

(58) Field of Classification Search ..... None
See application file for complete search history.

(56) References Cited

U.S. PATENT DOCUMENTS

| | | | | |
|---|---|---|---|---|
| 4,497,722 | A | 2/1985 | Tsuchida et al. | |
| 4,935,080 | A | 6/1990 | Hassell et al. | |
| 6,143,193 | A | 11/2000 | Akioka et al. | |
| 6,562,289 | B1 | 5/2003 | Staubach et al. | |
| 6,638,367 | B2 * | 10/2003 | Ohmori et al. | 148/105 |
| 6,709,533 | B2 | 3/2004 | Honkura et al. | |
| 6,900,559 | B2 | 5/2005 | Aizawa et al. | |

(Continued)

FOREIGN PATENT DOCUMENTS

DE 39 02 480 C2 9/1989

(Continued)

OTHER PUBLICATIONS

N. Hamada et al., "Development of Nd-Fe-B anisotropic bonded magnet with 27 MGOe", IEEE Transactions on Vo. 39, Issue 5, Sep. 2003, pp. 2953-2955 [English Abstract].

*Primary Examiner* — John Sheehan
(74) *Attorney, Agent, or Firm* — Buchanan Ingersoll & Rooney, PC

(57) ABSTRACT

A method for the production of pressed permanent magnets comprises the following steps: A mixture of at least one magnetic powder and a thermosetting binder is provided and pressed to produce a moulded body. In order to obtain a permanent and particularly reliable protection against oxidation and corrosion, the moulded body is impregnated with an acid and solvent mixture in an impregnating bath before the cure of the thermosetting binder, whereby the entire surface of the permanent magnet is coated with a reaction layer [FIG. 1].

28 Claims, 5 Drawing Sheets

U.S. PATENT DOCUMENTS

| | | | | |
|---|---|---|---|---|
| 6,926,963 | B2 | 8/2005 | Ohmori et al. | |
| 2001/0024068 | A1 | 9/2001 | Aizawa et al. | |
| 2002/0059965 | A1 | 5/2002 | Honkura et al. | |
| 2002/0084440 | A1 | 7/2002 | Ohmori et al. | |
| 2006/0099404 | A1 | 5/2006 | Yoshimura et al. | |
| 2006/0234085 | A1 * | 10/2006 | Nakano | 428/692.1 |

FOREIGN PATENT DOCUMENTS

| | | | |
|---|---|---|---|
| DE | 198 32 299 | A1 | 1/2000 |
| DE | 100 55 314 | A1 | 5/2001 |
| DE | 101 12 464 | A1 | 10/2001 |
| DE | 601 03 833 | T2 | 7/2005 |
| EP | 0 134 949 | B1 | 5/1987 |
| EP | 0 772 211 | A1 | 5/1997 |
| EP | 1 205 949 | A2 | 5/2002 |
| EP | 1 583 111 | A1 | 10/2005 |
| JP | 63-244705 | A | 10/1988 |
| JP | 63-304602 | A | 12/1988 |
| JP | 10 -14902 | | 1/1989 |
| JP | 64-014902 | A | 1/1989 |
| JP | 2263408 | A | 10/1990 |
| JP | 2005-101140 | A | 4/2005 |
| WO | WO 2004/064086 | A1 | 7/2004 |

* cited by examiner

NON-AGEING PERMANENT MAGNET FROM AN ALLOY POWDER AND METHOD FOR THE PRODUCTION THEREOF

BACKGROUND

1. Field

The invention relates to a permanent magnet pressed from an alloy powder and a thermosetting binder. It further relates to a method for the production of such a permanent magnet.

2. Description of Related Art

Permanent magnets which consist of an alloy powder, in particular a rare earth powder, and possibly of further additives, and which are bonded using a plastic material, can be produced in a great variety of precisely predetermined shapes by means of injection moulding or pressing technology without requiring any complex and costly reworking. Pressed permanent magnets, in particular permanent magnets pressed in a mould at ambient temperature and without heated tools, are formed from the alloy powder and a thermosetting binder and then cured. These magnets have particularly good magnetic properties and can moreover be produced very economically using very short cycle times.

Such pressed permanent magnets are, however, porous, which may result in oxidation or corrosion, for example by air and humidity, both during the curing process and during later use, in particular at elevated temperatures. The result is an ageing of the permanent magnet accompanied by a worsening of its magnetic properties. The term "ageing" of the magnet is here understood to mean a reduction of its magnetic properties over the course of time, in particular at elevated operating temperatures.

The ageing of the magnet can be inhibited by avoiding high operating temperatures. This limiting of the operating temperatures to, for example, 100° C. is, however, undesirable, as it prevents the use of pressed permanent magnets in many desirable fields, such as motors.

Various approaches have so far only resulted in insufficient and temporary protection of the permanent magnet against oxidation and corrosion. A thin coating on the outer surfaces of the finished magnet has been shown to be permeable and moreover easily damaged.

EP 1 583 111 A1 discloses a method for the production of pressed permanent magnets, wherein the individual powder particles are provided with a protective coating prior to the pressing process. However, as the coating is damaged in many places during the pressing process, resulting in new uncoated surfaces, a sufficient protection against oxidation and corrosion cannot be ensured. Even an additional impregnation with a synthetic resin, as disclosed in JP 63304602-A cannot ensure reliable and permanent protection.

SUMMARY

The invention is therefore based on the problem of specifying a method whereby permanently oxidation- and corrosion-resistant permanent magnets can be produced in a simple manner.

The present invention is further based on the problem of specifying a pressed permanent magnet with a particularly effective oxidation and corrosion protection, which can be used in temperatures above 100° C. without ageing prematurely.

In one embodiment, the invention relates to a method for the production of magnets comprises the following steps: First, a mixture of a magnetic powder and a thermosetting binder is provided and pressed to produce a moulded body of a desired shape. This moulded body is then exposed to a mixture of acid and solvent in an impregnating bath. The thermosetting binder is then cured. Suitable acids include phosphoric acid, oxalic acid, boric acid and chromic acid.

This method provides a permanently oxidation-resistant and corrosion-resistant permanent magnet that can be used at temperatures above 100° C. without the premature ageing described above.

In another embodiment, the invention relates to pressed, porous permanent magnets made according to the process disclosed herein.

In another embodiment, the invention relates to pressed, porous permanent magnet made from a rare earth alloy powder and a thermosetting binder, wherein the surface of the permanent magnet which forms an interface with ambient atmosphere is coated with a protective layer formed by reaction with an acid. This protective layer may include phosphates, molybdates, tungstates, vanadates, or titanates.

BRIEF DESCRIPTION OF THE DRAWINGS

Certain embodiments of the invention are explained in greater detail below with reference to the accompanying figures.

DETAILED DESCRIPTION OF SPECIFIC EMBODIMENTS

Figure 1:
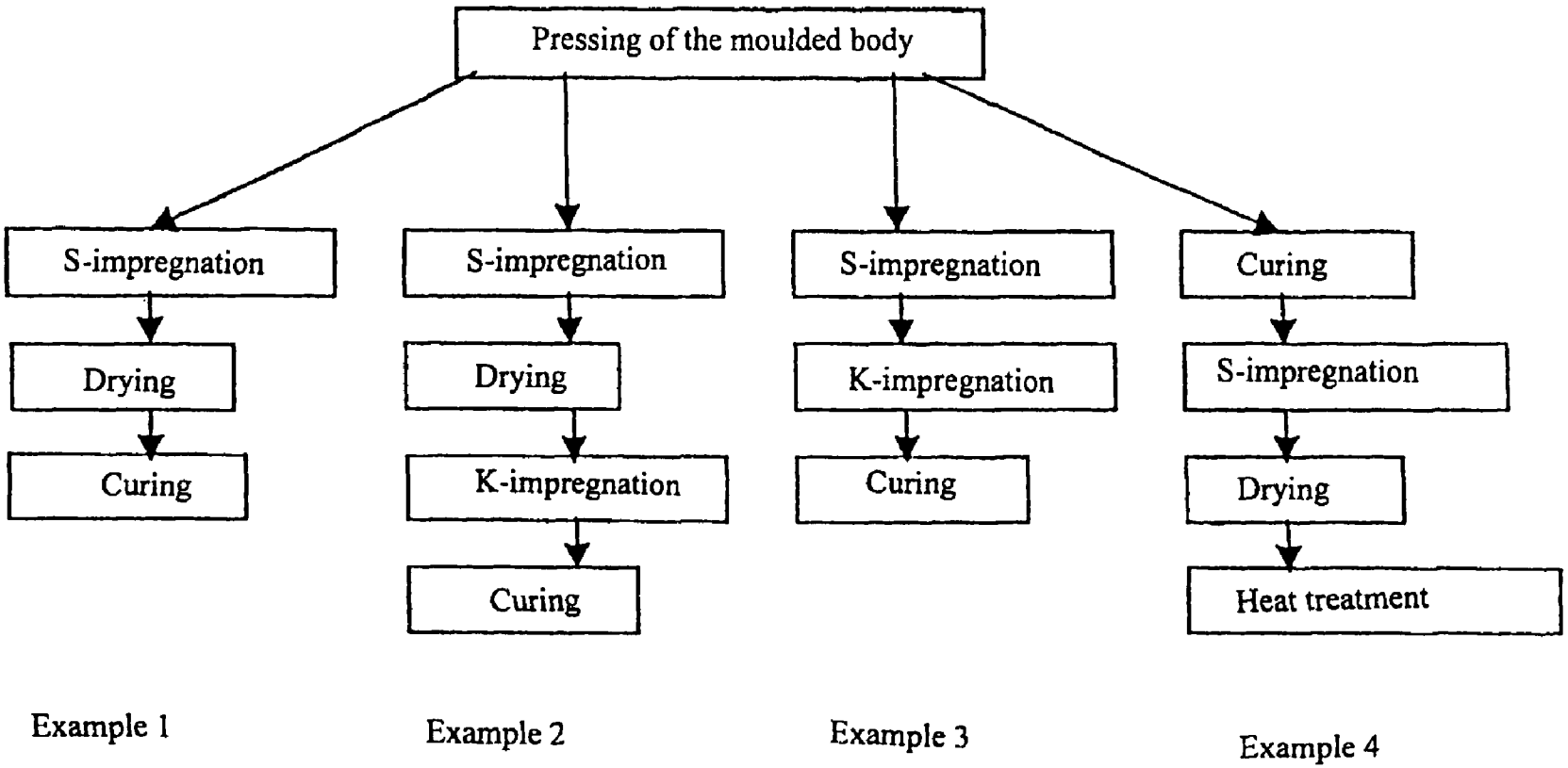
FIG. 1 is a flow chart showing certain specific embodiments of the method for the production of permanent magnets according to the invention.

The inventors have found that the entire surface of the magnet which forms an interface with an ambient atmosphere, and thus a surface affected by oxidising and corrosive substances, should be protected to provide an effective protection against oxidation and corrosion, i.e. in particular the internal surfaces of the magnet or the particles of which it consists. In place of a protective coating, which, in view of the resulting deviation from the original shape of the magnet, has to be very thin and is therefore easily damaged, the inventors have found that the interface should be protected by a protective layer formed by the action of an acid, such as a phosphating layer. In place of or in addition to phosphate, the protective layer may comprise molybdate, tungstate, titanate, oxalate, chromate or combinations thereof. Such a protective layer can be applied to the entire interface by immersing the porous moulded body in an impregnating bath containing a mixture of acid and solvent. Owing to its low viscosity, this mixture of acid and solvent reaches the surface including the entire accessible interstitial space and thus reaches substantially all portions of the magnet surface which may be affected by oxidising and corrosive substances.

The method according to the invention therefore protects the entire vulnerable surface by coating—if possible immediately after the pressing process—the metal surfaces accessible to corrosive substances such as oxygen and humidity by means of a chemical reaction under the participation of phosphoric acid. The penetration of substances into the accessible interstitial space is used to advantage in the impregnation process.

The moulded body is advantageously retained in the impregnating bath for at least 15 minutes, for example for 30 minutes. This ensures the formation of a sufficiently thick phosphating layer for the passivation of the surface. The retention time can be reduced by tempering the impregnating bath.

The impregnating solution, which advantageously has a composition of 2 to 6 percent by weight of 85%-phosphoric acid, preferably orthophosphoric acid $H_3PO_4$, 1 to 2 percent by weight of distilled water, rest alcohol or another common solvent, but may be just phosphoric acid dissolved or dispersed in water. This solution enters the externally accessible interstitial space of the pressed body as a result of the capillary effect. This effect can, however, be additionally supported by exposing the impregnating bath with the moulded body to a vacuum during the impregnation process. This vacuum promotes the escape of air from the interstitial space and accelerates the flow of impregnating agents into the pores. This flow can be improved further by introducing a gas into the space above the impregnating bath following the removal of air from the interstitial space, whereby a positive pressure is generated which enhances penetration by the impregnating solution.

In one embodiment of the invention, the magnetic powder used is a metal or alloy powder, in particular a hard magnetic alloy powder. The magnetic powders used in a preferred embodiment are Nd—Fe—B alloy powders, which contain the hard magnetic phase $Nd_2Fe_{14}B$ and are, for example, produced in accordance with the rapid solidification process or the hydrogenation disproportionation desorption recombination (HDDR) process. In this process, which is described in detail in U.S. Pat. No. 6,709,533 B2, the relatively coarse structure of the molten material initially disintegrates in a hydrogen atmosphere and then recombines to form a very fine-grained structure, while the crystal orientation of the original grain is maintained.

Alloys of samarium and cobalt containing the hard magnetic phases $Sm_2Co_{17}$ and/or $Sm_1Co_5$ can be used as alternatives.

In a particular embodiment, the average particle size d of the magnetic powder advantageously is $50\ \mu m \leqq d \leqq 150\ \mu m$. This average particle size allows for an advantageous packing density of 75% to 80% volume ratio. Finer or coarser powders than this tend to have worse magnetic properties and age more quickly. For additional protection against ageing, the particles of the magnetic powder may be coated even before the impregnation process, for example with a phosphating layer.

In a particular embodiment, the mixture is advantageously pressed to produce a moulded body under a pressure of 8 $t/cm^2$ at room temperature. In this process, the mixture can be exposed to a magnetic field.

The moulded body is, for example, cured at a temperature of at least 170° C., typically in an oven in the presence of air, in a particular embodiment. In a particular embodiment, the curing process takes approximately 60 minutes. The curing conditions are determined, at least in part, by the type of thermosetting material.

In a further embodiment, the impregnation process using the mixture of phosphoric acid and solvent is followed by a second impregnation step, wherein the moulded body is additionally impregnated with an epoxy resin. Between its impregnation with the mixture of phosphoric acid and solvent and this second impregnation step and/or before the curing of the thermosetting binder, the moulded body is advantageously dried, for example by evacuation. The acidic impregnating solution may, however, already contain a dissolved or dispersed plastic substance, for example a thermosetting resin. The resistance to ageing of the magnet according to the invention can be improved further if inorganic components such as silanes or titanates are added to the impregnating solution either concurrently or in a further step.

The method according to the invention offers the advantage that the surface can be coated with a protective layer in a particularly simple and effective way and without any major technical effort by using an impregnating bath. The coating process can further be accelerated and/or enhanced in a simple way by the use of pressure differentials. The method permits the complete coating of the permanent magnet including the externally accessible interstitial space with a reaction layer, whereby the magnets produced in this way are reliably protected against oxidation and corrosion.

According to the present invention, a pressed, porous permanent magnet made from a rare earth alloy powder and a thermosetting binder has a surface representing an interface with an ambient atmosphere, wherein this surface of the permanent magnet is coated with a reaction layer, preferably a phosphating layer.

As rare earth alloy powders, Nd—Fe—B alloys, which contain the hard magnetic phase $Nd_2Fe_{14}B$ and are, for example, produced in accordance with the rapid solidification process or the hydrogenation disproportionation desorption recombination (HDDR) process, or alloys of samarium and cobalt, which contain the hard magnetic phases $Sm_2Co_{17}$ and/or $Sm_1Co_5$, can be provided. Each of these is particularly suited to the process and products of this invention.

The permanent magnet according to the invention may have a remanence of 1.0 T and a coercitive field strength of 1060 kA/m. Its high energy product combined with a high dimensional stability resulting from the pressing process opens up a great variety of applications, for example in motors. The durably high load carrying capacity, even at elevated temperatures, which is required for such applications, is ensured by the phosphating layer.

In a first embodiment of the method, which is identified as "example 1" in FIG. 1, a mixture of 1.6 percent by weight of a thermosetting binder with the rest being a rare earth magnetic powder such as HDDR-Nd—Fe—B powder and various additives, if applicable, is oriented in a magnetic field and then pressed under a pressure of 8 $t/cm^2$ at room temperature to produce a moulded body with the dimensions 10×10×8.5 mm. The moulded body has a magnetic packing density of 75% and a porosity of approximately 17%.

After the pressing process, the moulded body is placed in a solution consisting of 4 percent by weight of 85% phosphoric acid, 1.2 percent by weight of distilled water and 94.8 percent by weight of isopropanol. The isopropanol may be replaced by another solvent, such as acetone, ethanol, butanol or water. This step is identified in FIG. 1 as "S-impregnation", an abbreviation for acid (Säure-) impregnation. During the impregnating process, the container with the impregnating solution and the moulded body is subjected to a vacuum of 150 mbar to facilitate the escape of air from, and the entry of the impregnating solution into, the interstitial space. After 30 minutes, the moulded body is removed, dried by evacuation and then cured in an oven for 60 minutes at a temperature of 170° C. in the presence of air.

In a second embodiment of the method, which is identified as "example 2" in FIG. 1, an additional impregnating step is added between the drying process and the curing process. In this second impregnating step, the moulded body is impregnated in a bath with a liquid, low-viscosity two-component epoxy resin. This step is identified in FIG. 1 as "K-impregnation", an abbreviation for plastic (Kunststoff-) impregnation. Initially, a vacuum of approximately 800 mbar supports the escape of air from the interstitial space, and then a positive pressure of approximately 200 mbar accelerates the entry of the resin into the pores. The cure is identical to example 1, but at a temperature of 190° C.

In a third embodiment, which is identified as "example 3" in FIG. 1, the method is carried out as in example 2, but the drying step between the two impregnating steps is omitted.

In a fourth embodiment, which is identified as "example 4" in FIG. 1, the moulded body is at least partially subjected to a first curing step before impregnation. This offers the advantage that the moulded body is less vulnerable when being handled in the impregnating and drying steps. Minor oxidation and corrosion damage may, however, have to be tolerated, because the moulded body is subjected to high temperatures and possibly to air before being protected by impregnation. After the impregnating and drying processes, the curing of the moulded body is completed.

FIG. 1 describes possible variants of the method by way of example only. Combinations thereof and further process steps are conceivable, for example if additional coatings are to be applied to the moulded body or certain properties of the moulded body are to be adjusted to requirements. Working in a protective atmosphere is also conceivable, for example if the curing step has to be carried out before impregnation.

Figure 2:
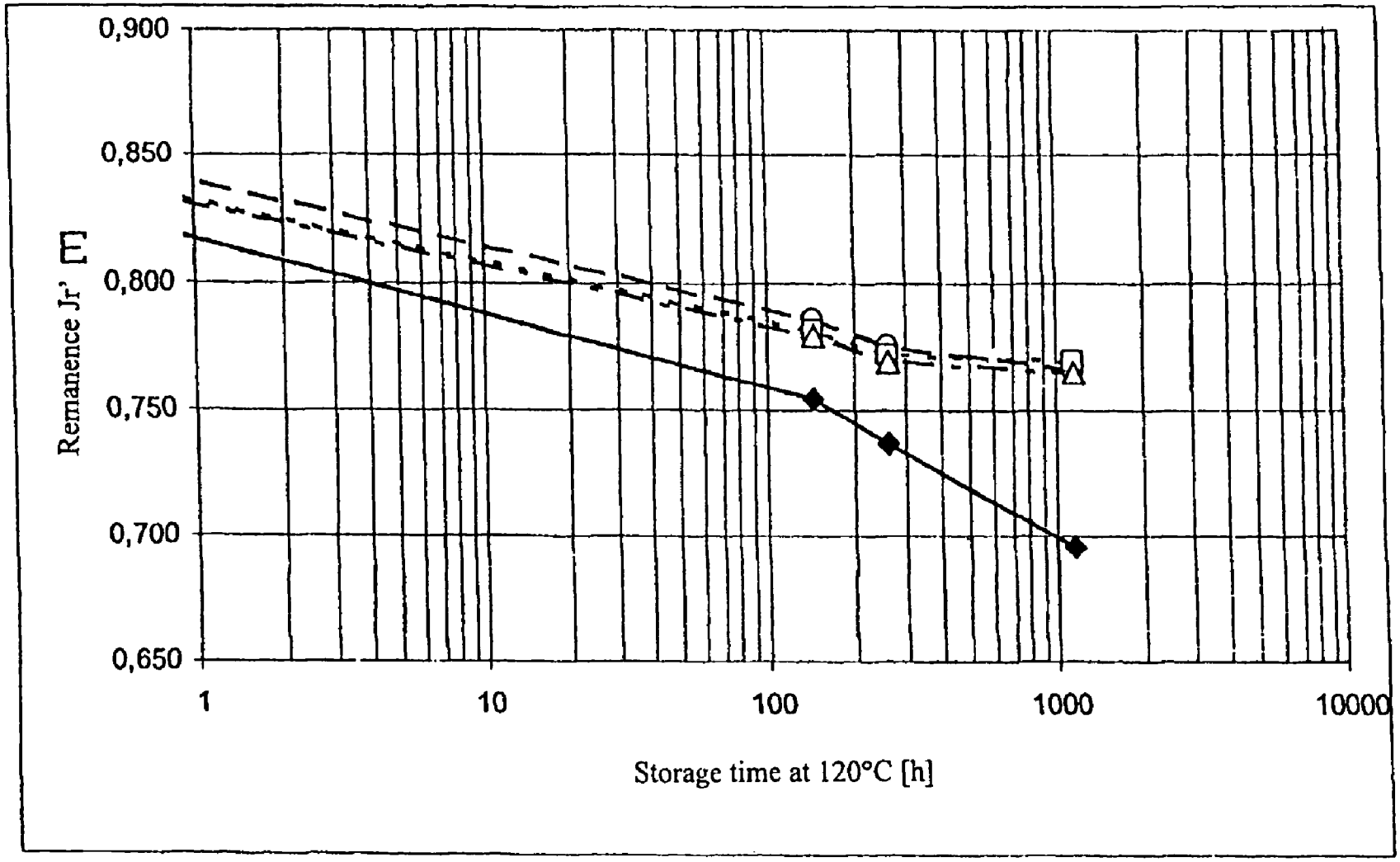
FIG. 2 is a graphical representation of the chronological development of the apparent remanence $J_r'$ of Nd—Fe—B permanent magnets according to certain embodiments of the invention.
Figure 3:
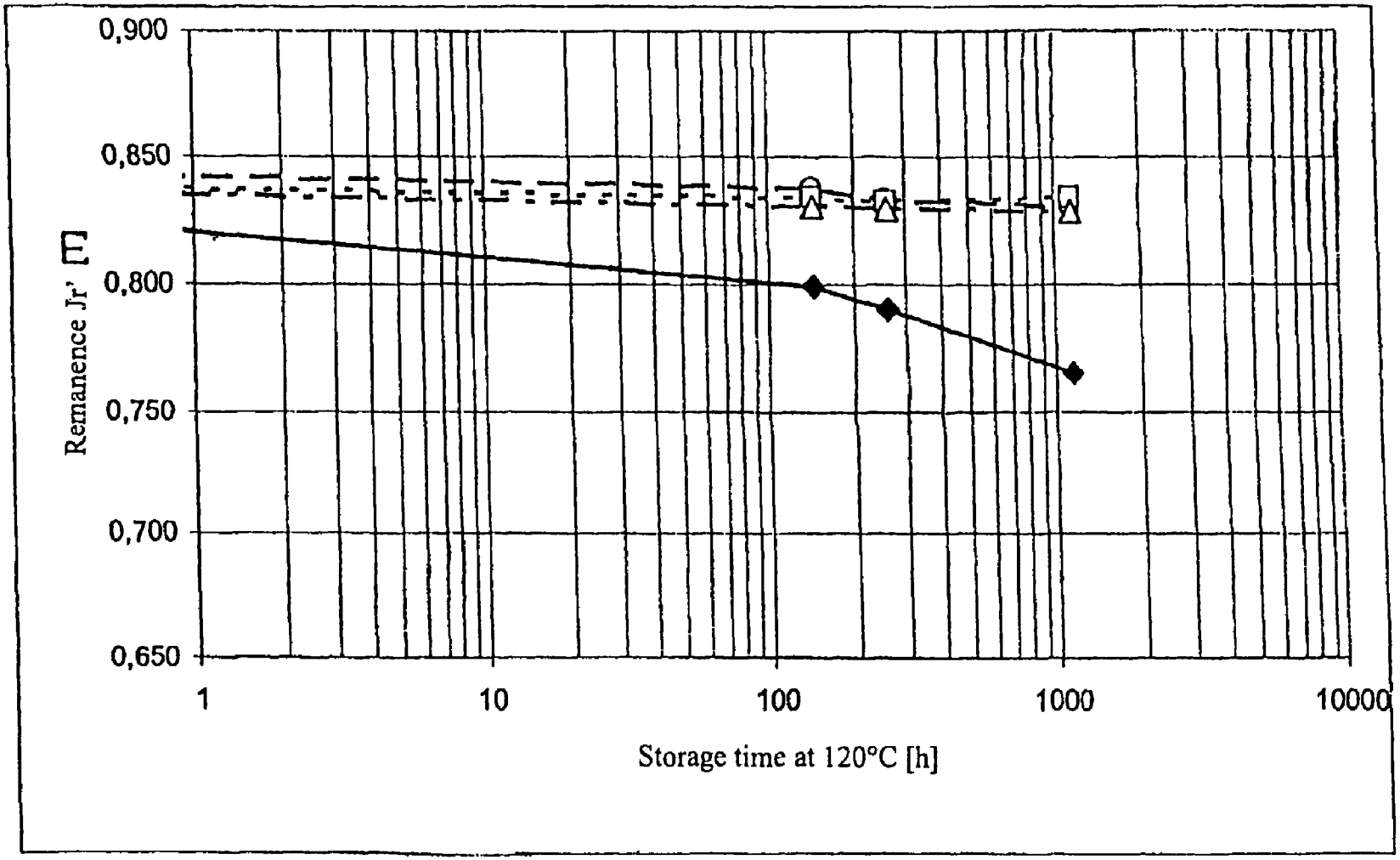
FIG. 3 is another graphical representation of the chronological development of the apparent remanence $J_r'$ of Nd—Fe—B permanent magnets according to certain embodiments of the invention.
Figure 4:
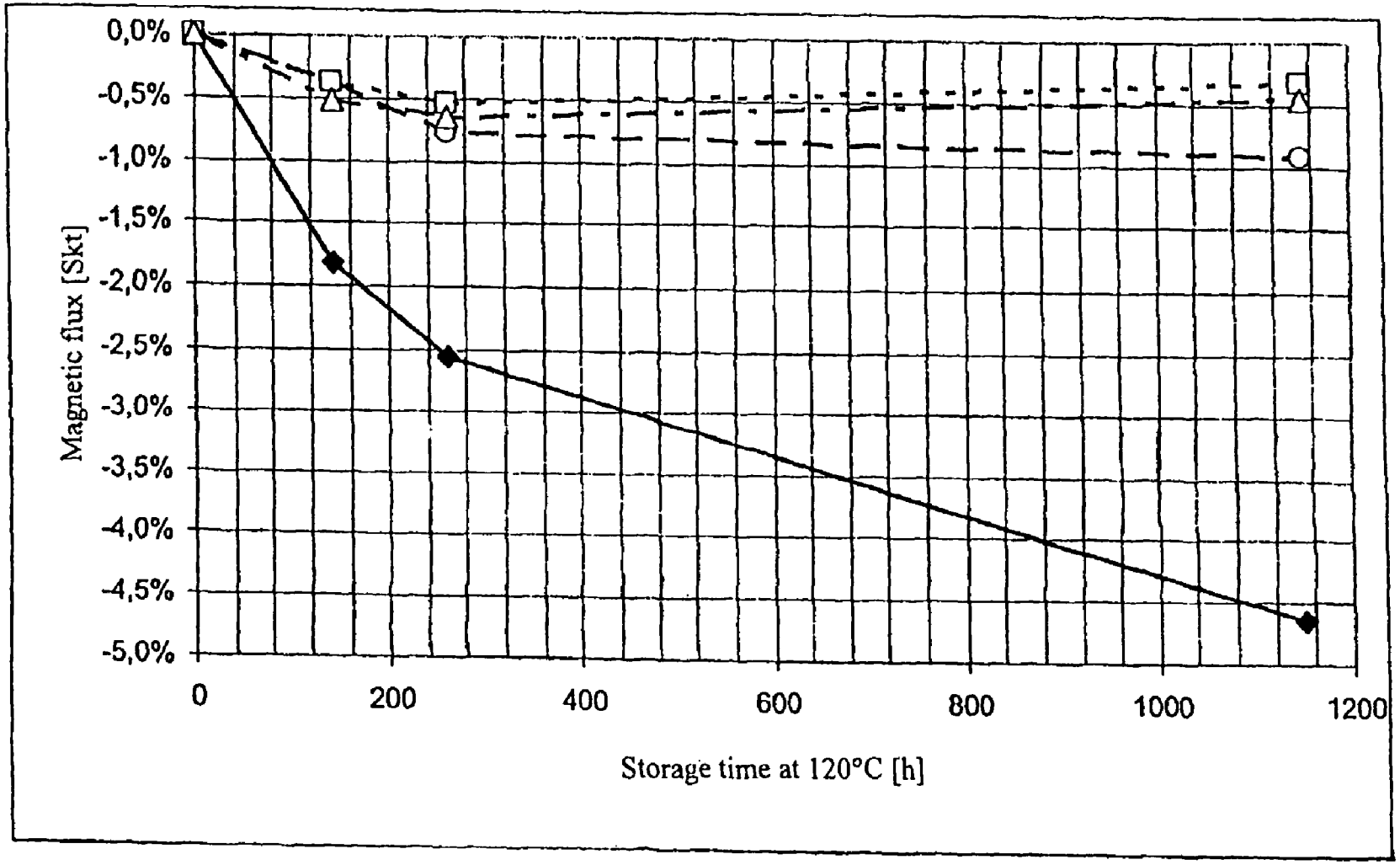
FIG. 4 is a graphical representation of the chronological development of the change of the magnetic flux of Nd—Fe—B permanent magnets according to certain embodiments of the invention.
Figure 5:
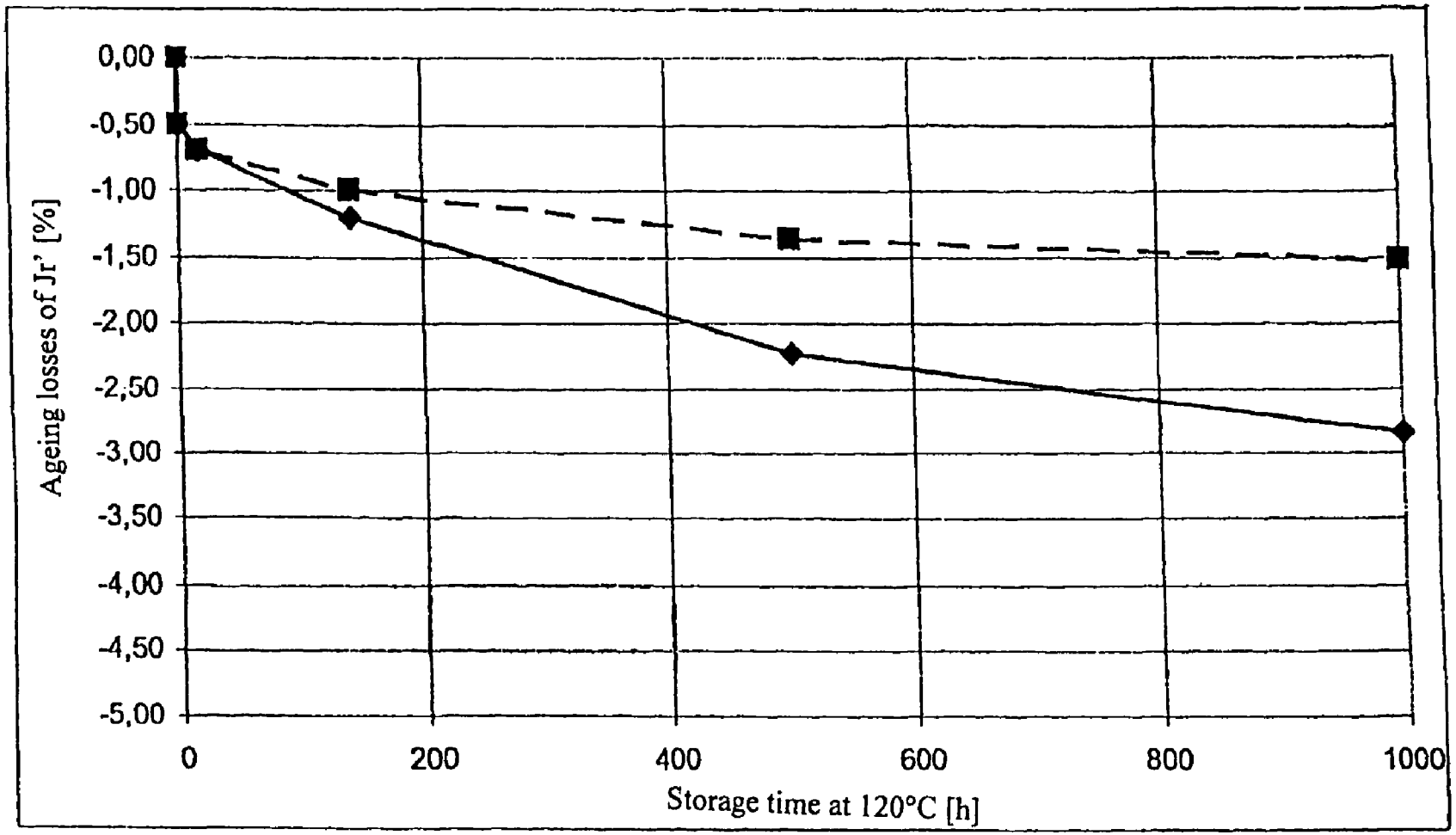
FIG. 5 is a graphical representation of the chronological development of the ageing losses of Sm—Co permanent magnets according to certain embodiments of the invention.

FIGS. 2 to 5 show the results of series of measurements aimed at improving the resistance to ageing of the permanent magnets according to the invention, FIGS. 2 to 4 representing measurements on permanent magnets made from an Nd—Fe—B powder and FIG. 5 representing measurements on permanent magnets made from an Sm—Co magnetic powder.

FIG. 2 illustrates the chronological development of the apparent remanence $J_r'$ of a permanent magnet according to the invention, which is a measure for ageing. The values illustrated by broken lines represent the ageing of permanent magnets produced using the methods according to examples 1, 2 and 3 in FIG. 1, while the values illustrated by a continuous line represent the ageing of a permanent magnet produced conventionally, i.e. not impregnated using the method according to the invention. The graphs relating to the values obtained from the method according to the invention are very close to one another and almost merge. This figure therefore shows clearly that the improvement obtainable by using the method according to the invention over conventional methods is greater than the spread of the values measured on permanent magnets produced using different variants of the method according to the invention.

Three permanent magnets were produced in accordance with each of the three methods according to the invention and with a conventional method. In each case, the average of the measured values of the three permanent magnets was plotted. All magnets were stored at approximately 120° C. in the presence of air to represent a realistic loading of the magnets, and the apparent remanence $J_r'$ was measured at varying time intervals. The series of measurements shown in FIG. 3 follow the same pattern, but all magnets were magnetised before each measurement.

FIGS. 2 and 3 show that the losses in the apparent remanence $J_r'$, which are a measure for the ageing of the magnets, are noticeably lower for the magnets according to the invention than for the non-impregnated magnets. The open triangles mark values measured on magnets impregnated with a plastic material in addition to their acid impregnation. The ageing losses of these magnets are slightly higher than those of cores exclusively impregnated with acid.

FIG. 4 shows the chronological development of the losses in magnetic flux as a measurement for ageing losses based on permanent structural damage; the magnets were magnetised before each measurement. The graph shows that the magnets produced using the method according to the invention, the values of which are indicated by broken lines, show losses of less than 1% after more than 1000 hours, while the conventionally produced magnets show average losses of approximately 4.7%.

FIG. 5 illustrates ageing losses of the apparent remanence $J_r'$ on the example of a magnet produced using the method according to the invention from a powder with the alloy composition $Sm_2Co_{17}$ consisting of 15% Fe, 25.2% Sm, rest Co, the powder having an average particle size of 110 μm. The magnet was produced in accordance with the variant of example 1 in FIG. 1. Magnets were produced from the same powder but without impregnation as comparative examples for the series of measurements shown in FIG. 5. As in the other figures, the results of the measurements on the magnets according to the invention are indicated by broken lines, while the results of the reference measurements are indicated by a continuous line. FIG. 5 shows that resistance to ageing can be improved significantly by impregnation in the Sm—Co magnets as well.

The invention having been described herein with reference to certain specific embodiments, it will be understood that these specific embodiments are intended to be illustrative only, and are not intended to limit the scope of the appended claims.

The invention claimed is:

1. A method for the production of a permanent magnet, comprising:

providing a mixture of at least one magnetic powder and a thermosetting binder;

pressing the mixture to produce a porous moulded body;

impregnating the porous moulded body in an impregnating bath with a solution containing an acid to produce an impregnated moulded body;

curing the thermosetting binder to produce a cured impregnated moulded body permanent magnet after said impregnating.

2. The method according to claim 1, wherein the solution containing an acid comprises phosphoric acid.

3. The method according to claim 1, wherein the impregnating bath comprises 2 to 6 percent by weight of 85%-phosphoric acid, 1 to 2 percent by weight of distilled water and rest alcohol.

4. The method according to claim 1, wherein the impregnating comprises retaining the moulded body in the impregnating bath for a retention time of at least 15 minutes.

5. The method according to claim 1, wherein the impregnating further comprises subjecting the moulded body to a vacuum, or to a positive pressure, or both.

6. The method according to claim 1, wherein the at least one magnetic powder comprises a metal or alloy powder.

7. The method according to claim 6, wherein the at least one magnetic powder comprises a hard magnetic alloy powder.

8. The method according to claim 7, wherein the magnetic powder comprises an alloy powder of neodymium, iron and boron containing the hard magnetic phase $Nd_2Fe_{14}B$.

9. The method according to claim 7, wherein the magnetic powder comprises an alloy powder of samarium and cobalt containing the hard magnetic phase $Sm_2Co_{17}$ or $Sm_1Co_5$.

10. The method according to claim 1, wherein the magnetic powder has an average particle size d, such that 50 μm≦d≦150 μm.

11. The method according to claim 1, further comprising applying a coating to the particles of the magnetic powder.

12. The method according to claim 5, wherein the impregnating further comprises subjecting the porous moulded body to a positive pressure after the application of the vacuum.

13. The method according to claim 1, wherein the pressing of the mixture comprises pressing the mixture at room temperature at a pressure of 6 t/cm$^2$ or more to produce a moulded body.

14. The method according to claim 1, further comprising exposing the mixture to a magnetic field during the pressing process.

15. The method according to claim 1, wherein the curing comprises exposing the moulded body to the presence of air at a temperature of at least 120° C.

16. The method according to claim 1, further comprising impregnating the moulded body with an epoxy resin in a second impregnation that follows the impregnation of the moulded body with the phosphoric acid and solvent mixture.

17. The method according to claim 16, further comprising drying the moulded body between its impregnation with the phosphoric acid and solvent mixture and the second impregnation step.

18. The method according to claim 1, wherein the solution containing an acid further comprises a plastic material or other organic components, or both.

19. The method according to claim 1, wherein the solution containing an acid further comprises inorganic components.

20. A pressed, porous permanent magnet made from a rare earth alloy powder and a thermosetting binder, wherein the surface of the permanent magnet which forms an interface with ambient atmosphere is coated with a protective layer formed by reaction with an acid.

21. The pressed, porous permanent magnet according to claim 20, wherein the protective layer comprises phosphate.

22. The pressed, porous permanent magnet according to claim 20, wherein the protective layer comprises molybdate.

23. The pressed, porous permanent magnet according to claim 20, wherein the protective layer comprises tungstate.

24. The pressed, porous permanent magnet according to claim 20, wherein the protective layer comprises vanadate.

25. The pressed, porous permanent magnet according to claim 20, wherein the protective layer comprises titanate.

26. The pressed, porous permanent magnet according to claim 20, wherein the rare earth alloy powder comprises a powder of neodymium, iron and boron containing a hard magnetic phase with the composition $Nd_2Fe_{14}B$ produced in accordance with a hydrogenation disproportionation desorption recombination (HDDR) process.

27. The pressed, porous permanent magnet according to claim 20, wherein the rare earth alloy powder comprises a powder of samarium and cobalt containing a hard magnetic phase with the composition $Sm_2Co_{17}$ or $Sm_1Co_5$.

28. The pressed, porous permanent magnet produced according to the method of claim 1.

* * * * *